US010494937B2

(12) United States Patent
Tomsik

(10) Patent No.: US 10,494,937 B2
(45) Date of Patent: Dec. 3, 2019

(54) INNER RING FOR AN ANNULAR GUIDE VANE ASSEMBLY OF A TURBOMACHINE

(71) Applicant: MTU Aero Engines AG, Munich (DE)

(72) Inventor: Joseph Tomsik, Munich (DE)

(73) Assignee: MTU Aero Engines AG, Munich (DE)

( * ) Notice: Subject to any disclaimer, the term of this patent is extended or adjusted under 35 U.S.C. 154(b) by 284 days.

(21) Appl. No.: 15/682,753

(22) Filed: Aug. 22, 2017

(65) Prior Publication Data

US 2018/0058231 A1 Mar. 1, 2018

(30) Foreign Application Priority Data

Aug. 23, 2016 (DE) ..... 10 2016 215 807

(51) Int. Cl.

| | |
|---|---|
| ***F01D 25/16*** | (2006.01) |
| ***F01D 9/04*** | (2006.01) |
| ***F01D 11/00*** | (2006.01) |
| ***F01D 25/24*** | (2006.01) |
| *F01D 17/16* | (2006.01) |

(52) U.S. Cl.

CPC ..... *F01D 9/042* (2013.01); *F01D 11/005* (2013.01); *F01D 25/162* (2013.01); *F01D 25/246* (2013.01); *F01D 17/162* (2013.01); *F05D 2260/36* (2013.01)

(58) Field of Classification Search

CPC ..... F01D 9/42; F01D 11/005; F01D 25/162; F01D 25/246; F01D 17/162; F05D 2260/36

USPC ..... 415/148

See application file for complete search history.

(56) References Cited

U.S. PATENT DOCUMENTS

RE21,272 E * 11/1939 Hallerberg ..... F02M 35/026 55/322
2,651,496 A * 9/1953 Buckland ..... F01D 9/065 415/135
2,835,515 A * 5/1958 Solari ..... F16J 15/38 277/372
2,936,155 A * 5/1960 Howell ..... F01D 5/22 416/134 R
3,303,992 A * 2/1967 Johnson ..... F01D 17/162 415/149.4

(Continued)

FOREIGN PATENT DOCUMENTS

DE 2331893 1/1974
DE 10 2005 042 747 3/2007

(Continued)

*Primary Examiner* — Justin D Seabe
*Assistant Examiner* — Brian Christopher Delrue
(74) *Attorney, Agent, or Firm* — Davidson, Davidson & Kappel, LLC

(57) ABSTRACT

An inner ring (14) for an annular guide vane assembly (10) of a turbomachine, which inner ring enables variable guide vanes (12) to be rotatably supported is provided. The inner ring (14) includes a first and a second securing ring (16*a*, 16*b*) which are connected together by at least one securing element (18) extending axially with respect to a centerline (M) of the inner ring (14). The at least one securing element (18) includes a vane bearing (20) which projects radially with respect to the centerline (M) and which corresponds to an associated guide vane (12) and is adapted for rotatably supporting the same. A method for manufacturing an annular guide vane assembly (10) of a turbomachine using such an inner ring (14) is also provided.

21 Claims, 3 Drawing Sheets

(56) References Cited

U.S. PATENT DOCUMENTS 3,487,879 A * 1/1970 McCarthy ..... F04D 29/324 416/220 A
3,843,279 A * 10/1974 Crossley ..... F01D 9/042 415/191
3,870,434 A * 3/1975 Paulson ..... F01D 7/00 416/160
3,887,297 A * 6/1975 Welchek ..... F01D 17/162 415/161
3,929,392 A * 12/1975 Ogino ..... F16C 17/02 384/215
4,047,840 A * 9/1977 Ravenhall ..... F04D 29/323 416/135
4,363,600 A * 12/1982 Thebert ..... F01D 17/162 415/140
4,498,790 A * 2/1985 Fisher ..... F01D 17/162 384/296
4,514,141 A * 4/1985 Marey ..... F01D 17/162 415/160
4,604,030 A * 8/1986 Naudet ..... F01D 11/001 415/126
4,706,354 A * 11/1987 Naudet ..... F01D 17/162 29/428
4,834,613 A * 5/1989 Hansen ..... F01D 17/162 415/160
4,861,228 A * 8/1989 Todman ..... F01D 17/162 415/115
4,877,376 A * 10/1989 Sikorski ..... B64C 11/04 416/207
4,990,056 A * 2/1991 McClain ..... F01D 11/001 29/889.22
5,022,824 A * 6/1991 Violette ..... B64C 11/008 416/230
5,102,302 A * 4/1992 Schilling ..... B64C 11/04 416/134 A
5,165,856 A * 11/1992 Schilling ..... B64C 11/04 416/204 A
5,205,714 A * 4/1993 Shah ..... B64C 11/04 416/217
D341,145 S * 11/1993 Esworthy ..... D15/143
5,259,728 A * 11/1993 Szpunar ..... F01D 5/3007 416/2
5,324,165 A * 6/1994 Charbonnel ..... F01D 11/003 415/160
5,636,968 A * 6/1997 Audet ..... F01D 17/162 415/160
5,664,536 A * 9/1997 Bigsby ..... F16J 9/24 123/193.4
5,796,199 A * 8/1998 Charbonnel ..... F01D 17/162 310/60 A
6,086,327 A * 7/2000 Mack ..... F01D 17/162 384/273
6,129,512 A * 10/2000 Agram ..... F01D 17/162 415/160
6,257,593 B1 * 7/2001 White ..... F16J 15/064 277/630
6,435,519 B1 * 8/2002 White ..... F16J 15/0806 277/609
6,457,721 B1 * 10/2002 Bloemers ..... F16J 9/24 277/445
6,481,960 B2 * 11/2002 Bowen ..... F01D 11/001 415/160
6,550,779 B2 * 4/2003 Bjornson ..... F16J 15/3488 277/370
6,637,995 B1 * 10/2003 White ..... F16B 19/02 411/339
6,682,299 B2 * 1/2004 Bowen ..... F01D 9/02 384/273
6,790,000 B2 * 9/2004 Wolf ..... F01D 17/162 415/165
D517,900 S * 3/2006 Goldenberg ..... D8/354
7,244,098 B2 * 7/2007 Bromann ..... F01D 17/162 415/160
7,360,990 B2 * 4/2008 Barbe ..... F01D 17/162 384/296
7,510,369 B2 * 3/2009 Lytle ..... F01D 17/162 29/889.22
7,670,106 B2 * 3/2010 Bouru ..... F01D 9/042 415/148
8,328,512 B2 * 12/2012 Major ..... F01D 17/162 415/209.4
D681,512 S * 5/2013 Verbowski ..... D12/159
8,448,993 B2 * 5/2013 Cumic ..... F16L 21/022 285/112
8,770,930 B2 * 7/2014 Merrill ..... F01D 5/147 29/889.21
8,951,010 B2 * 2/2015 Major ..... F01D 17/162 415/209.4
9,353,643 B2 * 5/2016 Major ..... F01D 17/162
9,874,243 B2 * 1/2018 McKinnon ..... B60B 27/00
9,926,944 B2 * 3/2018 Mouton ..... F01D 17/162
9,932,988 B2 * 4/2018 Maliniak ..... F04D 29/563
9,970,314 B2 * 5/2018 Stiehler ..... F01D 9/042
10,125,789 B2 * 11/2018 Maliniak ..... F04D 29/563
10,280,941 B2 * 5/2019 Mouton ..... F01D 17/162
10,287,904 B2 * 5/2019 Filipenco ..... F01D 9/04
10,344,622 B2 * 7/2019 Amadon ..... F04D 29/644
2003/0113204 A1 * 6/2003 Wolf ..... F01D 17/162 415/165
2003/0170115 A1 * 9/2003 Bowen ..... F01D 9/02 415/160
2007/0059161 A1 * 3/2007 Bouru ..... F01D 17/162 415/160
2007/0166151 A1 * 7/2007 Burdgick ..... F01D 9/044 415/191
2008/0031730 A1 * 2/2008 Houradou ..... F01D 17/162 415/173.2
2011/0142651 A1 * 6/2011 Lhoest ..... F01D 5/26 416/182
2012/0051918 A1 * 3/2012 Glasspoole ..... F01D 5/025 416/204 A
2012/0319360 A1 * 12/2012 Blaney ..... F01D 11/08 277/590
2014/0234086 A1 * 8/2014 Maliniak ..... F04D 29/563 415/159
2015/0098813 A1 * 4/2015 Jarrett, Jr. ..... F01D 9/042 415/209.3
2016/0097287 A1 * 4/2016 Goldfinch ..... F01D 5/326 416/220 R
2016/0208637 A1 * 7/2016 Maliniak ..... F01D 17/162
2016/0290360 A1 * 10/2016 Tanaka ..... F01D 25/243
2016/0363133 A1 * 12/2016 Mouton ..... F01D 17/162
2017/0362958 A1 * 12/2017 Von Berg ..... F01D 25/164
2018/0023408 A1 * 1/2018 Rice ..... F01D 11/08 415/173.1
2018/0023420 A1 * 1/2018 Amadon ..... F01D 9/041 415/209.2
2019/0127045 A1 * 5/2019 Devaux ..... B64C 11/14

FOREIGN PATENT DOCUMENTS

EP 0696675 2/1996
EP 1696134 8/2006
EP 1760272 A2 * 3/2007 ..... F01D 17/162
GB 705150 A * 3/1954 ..... F01D 9/065
WO WO-2015155442 A1 * 10/2015 ..... F04D 29/102

* cited by examiner

INNER RING FOR AN ANNULAR GUIDE VANE ASSEMBLY OF A TURBOMACHINE

This claims the benefit of German Patent Application DE 102016215807.4, filed Aug. 23, 2016 and hereby incorporated by reference herein.

The present invention relates to an inner ring for an annular guide vane assembly of a turbomachine, a method for manufacturing an annular guide vane assembly of a turbomachine, as well as a turbomachine having at least one such inner ring and/or annular guide vane assembly.

BACKGROUND

Multi-stage turbomachines, such as, for example, thermal gas turbines, often include an annular guide vane assembly between each two adjacent rotor stages. At least part of these annular guide vane assemblies are equipped with variable guide vanes to selectively deflect the respective working fluid of the turbomachine such that the working fluid impinges on the downstream rotor stage at an optimum angle. The variable guide vanes are rotatably supported at their one ends in an outer ring or casing or the turbomachine and at the other ends in an inner ring.

DE 10 2005 042 747 describes a gas turbine including an annular guide vane assembly disposed as a stator stage in a compressor, the annular guide vane assembly having an inner ring composed of elastically deformable semicircular ring segments. To assemble the inner ring, the inner ring is deformed until radially inner trunnions of the guide vanes can be positioned in respective bushings of the inner ring. Upon relaxation of the inner ring, it is connected to a support.

SUMMARY OF THE INVENTION

The known inner ring and an annular guide vane assembly provided with this inner ring have the disadvantage that, because of the elastic deformability of the inner ring, the inner ring has comparatively low mechanical strength and aerodynamic load-bearing capability for a given overall axial length, which, during operation of the associated turbomachine, may result in flow losses and an associated impairment of the efficiency, the surge line, and the power output of the turbomachine.

It is an object of the present invention to provide an inner ring for an annular guide vane assembly of a turbomachine that will have higher mechanical and aerodynamic load-bearing capability. Further objects of the present invention are to provide a method for manufacturing an annular guide vane assembly having higher mechanical and aerodynamic load-bearing capability, as well as a correspondingly improved turbomachine.

These objects are achieved in accordance with the present invention by an inner ring, a method, as well as a turbomachine. Advantageous embodiments including useful refinements of the present invention are presented below as well. Advantageous embodiments of each inventive aspect are considered to be advantageous embodiments of the respective other inventive aspects and vice versa.

A first aspect of the present invention relates to an inner ring for an annular guide vane assembly of a turbomachine, which inner ring enables variable guide vanes to be rotatably supported. In accordance with the present invention, higher mechanical and aerodynamic load-bearing capability is obtained for the inner ring, and thus for the annular guide vane assembly, by the inner ring including a first and a second securing ring which are connected together by at least one securing element extending axially with respect to a centerline of the inner ring, the at least one securing element including a vane bearing which projects radially with respect to the centerline and which corresponds to an associated guide vane and is adapted for rotatably supporting the same. In other words, the inner ring according to the present invention includes two securing rings connected together by one or more axially disposed securing elements, each securing element additionally including a radially projecting or protruding vane bearing, thus uniting in itself the functions of both axially securing and rotatably supporting an associated guide vane. In addition, dividing the inner ring into two securing rings eliminates the need for the securing rings to be elastically deformable because the securing rings can be positioned at the guide vanes from an upstream side and a downstream side and be united by the at least one securing element to form the inner ring. Due to the higher mechanical and aerodynamic load-bearing capability of the inner ring, it is possible to improve the efficiency, surge line and power output of an associated turbomachine while maintaining the same overall axial length of the associated stator stage and the associated annular guide vane assembly. Moreover, by integrating these two functions into the securing element, some space is gained because no additional space is needed for through-bolts or other securing means. This makes it possible to reduce the vane pitch; i.e., the circumferential spacing of the guide vanes, thereby achieving additional aerodynamic advantages. Alternatively, it is possible to reduce the overall axial length of the stator stage provided with the inner ring and of the annular guide vane assembly provided with the inner ring as compared to the prior art while maintaining the same mechanical and aerodynamic load-bearing capability. It is preferred for the inner ring to include such a securing element for each guide vane. In the context of the present invention, terms such as "radial" and "axial" generally refer to the centerline of the inner ring, which, in the assembled state, extends coaxially with an axis of rotation of an associated turbomachine. The securing rings can generally be produced using turning and/or milling techniques or additively, for example, by selective laser melting. The securing element(s) can generally also be produced additively, for example, by selective laser melting. However, alternatively, other manufacturing techniques, such as forging and/or milling, are also conceivable.

An advantageous embodiment of the present invention provides that the securing element include a vane bearing in the form of a bushing in which is positionable a trunnion of the associated guide vane, or that the securing element include a vane bearing in the form of a trunnion which is positionable in a bushing of the associated guide vane. In this manner, the securing element can be optimally adapted to the particular design of the associated guide vane as a counterpart.

In another advantageous embodiment of the present invention, provision is made for the first securing ring and/or the second securing ring to be segmented. For example, the first securing ring and/or the second securing ring may be divided into two, three, four or more ring segments. In certain applications, this segmentation facilitates the assembly of the respective securing ring, and thus of the annular guide vane assembly.

Additional advantages are obtained when the first securing ring and/or the second securing ring carry/carries a sealing element, in particular a honeycomb seal. In this manner, the inner ring can be sealed with respect to other components of the turbomachine, thereby contributing to a further reduction in flow losses. The sealing element may be connected to the respective securing ring by a material-to-material bond, for example by brazing. Alternatively, the respective securing ring may be additively manufactured together with the sealing element. However, other manufacturing techniques are also conceivable.

Another advantageous embodiment of the present invention provides that the securing element be non-rotatably, in particular interlockingly, disposed in a corresponding, preferably polygonal, mounting aperture of the first securing ring and/or the second securing ring. In other words, provision is made for the securing element to have, along its axial extent, one or more regions that are geometrically configured such that the securing element is non-rotatably disposed in an associated mounting aperture. For example, the respective region of the securing element and the associated mounting aperture may be oval, triangular, square, rectangular or polygonal in cross section, which ensure a fluid-tight and non-rotatable arrangement. In addition, a guide vane supported by the securing element is thus particularly reliably prevented from tilting. The mounting aperture(s) may be formed in the respective securing ring, for example, by drilling, milling and/or electrochemical machining (ECM/PEM). When both securing rings are to have mutually aligned mounting apertures, it has proved advantageous to pair the securing rings according to their assembled position and to create the mounting apertures together in order to minimize tolerances.

Further advantages are obtained when the securing element is coupled, in a first end region, to a retaining element in the form of a check plate. In this way, the securing element can be axially supported against one of the securing rings and is protected from falling out, at least in one direction.

Furthermore, it has proved to be advantageous if the check plate is U-shaped and/or disposed in a groove of the securing element. Thus, the check plate can be installed simply by pushing it onto the securing element.

Another advantageous embodiment of the present invention provides that the first securing ring and/or the second securing ring have/has a receiving profile in which the check plate is captively received. The receiving profile may in principle also be formed by the first and second securing rings, when in their assembled position, so that each of the securing rings, in and on itself, provides only a portion of the receiving profile. Alternatively or additionally, provision is made for the check plate to rest on the second securing ring. This makes it impossible for the check plate to unintentionally fall out in a radial direction during operation of an associated turbomachine.

Further advantages are obtained when the securing element is affixed, in a second end region, to the second securing ring by a retaining element, preferably in the form of a nut. In this way, the securing element can be axially supported against the respective securing ring and is protected from falling out, at least in one direction. If a nut is used as the retaining element, the securing element preferably has a corresponding thread.

Additional advantages are obtained when the vane bearing of the securing element is sealed with respect to the first securing ring and/or the second securing ring by means of a sealing element, in particular a sealing ring. This further reduces flow through the securing rings.

A second aspect of the present invention relates to a method for manufacturing an annular guide vane assembly of a turbomachine. In this method, at least the following steps are carried out: a) providing an outer ring and a plurality of variable guide vanes, b) inserting radially outer vane bearings of the guide vanes into the outer ring, c) connecting radially inner vane bearings of the guide vanes each to a respective radially projecting vane bearing of an associated securing element, d) positioning a first securing ring on respective first end regions of the securing elements, e) positioning a retaining element on each of the first end regions of the securing elements, the retaining elements limiting axial movement of the first securing ring relative to the securing elements, f) positioning a second securing ring on respective second end regions of the securing elements such that the securing elements extend axially between the first and second securing rings, and g) positioning a retaining element on each of the second end regions of the securing elements, the retaining elements limiting axial movement of the second securing ring relative to the securing elements. Through the use of the inner ring constructed in accordance with the first aspect of the invention for manufacturing the annular guide vane assembly, the annular guide vane assembly has higher mechanical strength and aerodynamic load-bearing capability for a given overall axial length as compared to annular guide vane assemblies known from the prior art. The outer ring can generally be formed in one piece or as part of the casing. It will be apparent to those skilled in the art that the indicated sequence of steps may, at least partially, be altered without departing from the scope of the inventive method. It may also be provided that the indicated steps may be performed in reverse order to disassemble the annular guide vane assembly. In this case, too, corresponding variations in the sequence of steps are conceivable.

In an advantageous embodiment of the present invention, in step c), bushings are inserted, as radially inner vane bearings, into inner disks of the guide vanes, and trunnions are inserted, as radially projecting vane bearings of the securing elements, into the bushings. Alternatively or additionally, in step c), trunnions are inserted, as vane bearings of the guide vanes, into respective bushings as radially projecting vane bearings of the securing elements. This allows the rotatable supporting of the guide vanes by the securing elements to be implemented depending on the specific design of the guide vanes and the available space.

Further advantages are obtained when, in step e), a retaining element in the form of a check plate is inserted radially from the inside into each of the grooves in the first end regions of the securing elements and, after positioning the second securing ring in step f), the retaining element rests on the second securing ring. In this way, the retaining element is reliably protected from falling out.

In another advantageous embodiment of the present invention, a mechanically particularly stable connection of the inner ring is made possible by, in step g), threading nuts as retaining elements onto the second end regions of the securing elements until the first and second securing rings are fixedly attached to one another via the securing elements.

A third aspect of the present invention relates to a turbomachine, in particular an aircraft engine, including at least one inner ring according to the first aspect of the present invention and/or at least one annular guide vane assembly manufactured using a method according to second aspect of invention. The resulting features and their advantages can be inferred from the descriptions of the first and second aspects of the invention.

BRIEF DESCRIPTION OF THE DRAWINGS

Other features of the present invention will become apparent from the claims, the figures, and the detailed description. The features and feature combinations mentioned above in the description as well as the features and feature combinations mentioned below in the detailed description and/or shown in isolation in the figures are usable not only in the respectively specified combination, but also in other combinations without departing from the scope of the present invention. Thus, embodiments of the invention that are not explicitly shown and described in the figures, but derive from and can be produced by separate feature combinations from the explained embodiments, are also considered to be included and disclosed herein. In addition, embodiments and combinations of features that therefore do not have all of the features of an originally formulated independent claim are also considered to be disclosed herein. In the drawing.

DETAILED DESCRIPTION

Figure 1:
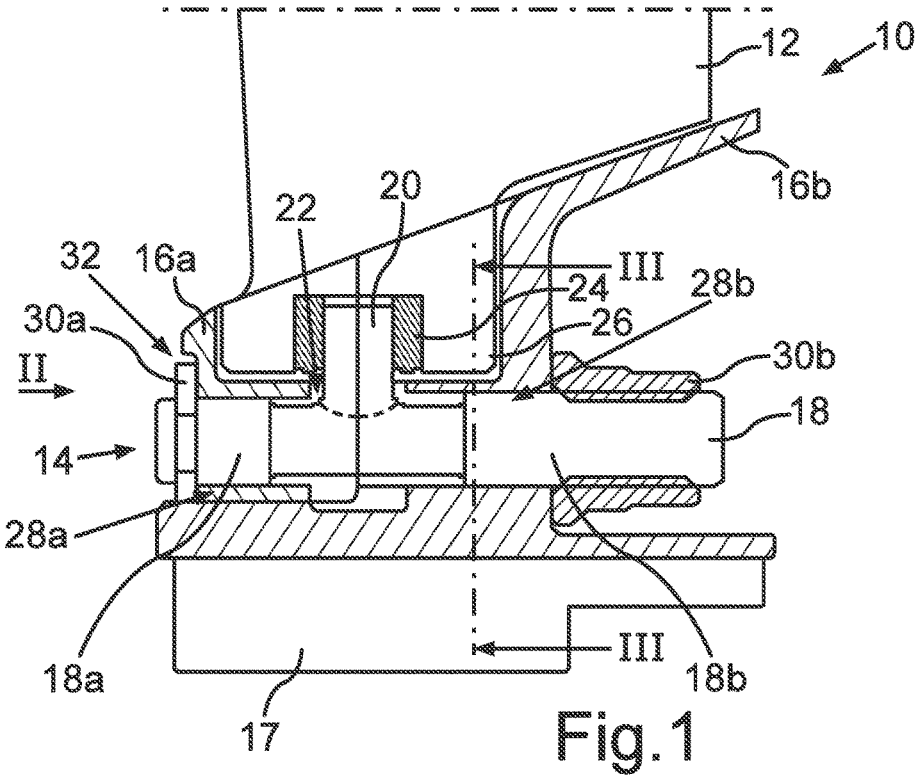
FIG. 1 is a schematic cross-sectional side view of an inventive inner ring for an annular guide vane assembly according to a first exemplary embodiment.
Figure 2:
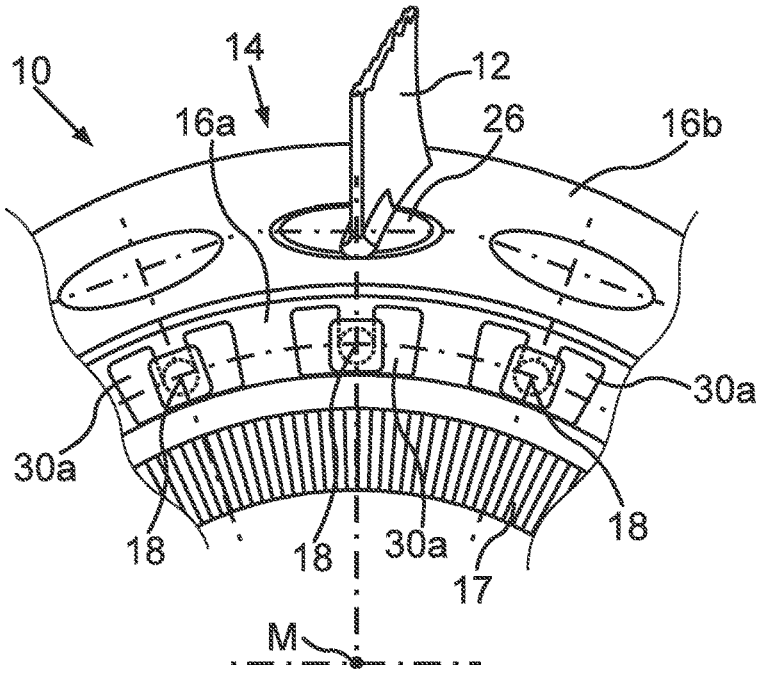
FIG. 2 is a perspective detail view of the annular guide vane assembly, looking in the direction of flow.
Figure 3:
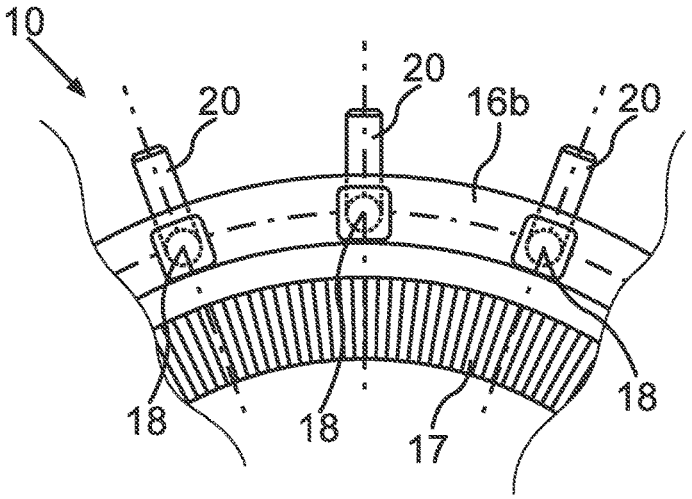
FIG. 3 is a schematic cross-sectional view of the annular guide vane assembly.

FIG. 1 shows, in schematic cross-sectional side view, an inventive inner ring 14 for an annular guide vane assembly 10 according to a first exemplary embodiment. In this view, only the radially inner region is shown. FIG. 1 will be described below in conjunction with FIGS. 2 and 3. FIG. 2 shows a perspective detail view of annular guide vane assembly 10, looking in the direction of flow indicated by arrow II, and FIG. 3 shows annular guide vane assembly 10 in a schematic cross-sectional view taken along line III-III. Annular guide vane assembly 10 includes a plurality of variable guide vanes 12 rotatably supported in an inner ring 14. Inner ring 14 constitutes a separate aspect of the present invention. Inner ring 14 includes an axially forward first securing ring 16*a* and an axially rearward second securing ring 16*b*, viewed in the direction of flow, between which, for each guide vane 12, a securing element 18 extends axially with respect to a centerline M of inner ring 14. Securing rings 16*a*, 16*b* may be formed independently of each other as 360° or ring elements, or may be segmented, for example, in the form of half-ring elements. The axially rearward securing ring 16*b* additionally carries a sealing element 17, which here takes the form of a honeycomb seal and is connected to securing ring 16*b* by brazing. Securing element 18 includes, approximately in the middle thereof, a radially outwardly projecting vane bearing 20, which here takes the form of a trunnion. It is clear that, in the assembled state, securing rings 16*a*, 16*b* form an opening 22 through which vane bearing 20 protrudes. Guide vane 12, in turn, includes a vane bearing in the form of a bushing 24 which is disposed in a hole in the region of inner disk 26 and into which is inserted trunnion 20 of securing element 18.

Securing element 18 includes a first region 18*a* and a second region 18*b*, which are square or quadrangular in cross section. In these regions 18*a*, 18*b*, securing element 18 is interlockingly and non-rotatably disposed in corresponding mounting apertures 28*a*, 28*b* in first and second securing rings 16*a*, 16*b*, respectively. In this way, guide vane 12 is additionally secured from tilting when in its installed position.

In order to axially position securing element 18 and securing rings 16*a*, 16*b* and fixedly attach them to one another, a retaining element 30*a* in the form of a U-shaped check plate is pushed onto a first end region of securing element 18. It can be seen that retaining element 30*a* rests on second securing ring 16*b* and is received in a corresponding receiving profile 32. In this way, retaining element 30*a* is reliably prevented from unintentionally falling out. A retaining element 30*b* in the form of a nut is threaded to securing element 18 at the opposite end region thereof, thereby connecting securing rings 16*a*, 16*b* together via a securing element 18.

In order to assemble annular guide vane assembly 10, the radially outer ends of guide vanes 12 are inserted into a single-piece outer ring or into a casing of a turbomachine. Then, a bushing 24 and a securing element 18 are inserted into each of the inner disks 26 of the various guide vanes 12. Subsequently, first securing ring 16*a* is slid onto securing elements 18 from the front, and retaining elements 30*a* are radially pushed onto securing elements 18 from below. After that, second securing ring 16*b* is slid onto securing elements 18 from the rear, thereby at the same time securing retaining elements 30*a* from falling out radially. Finally, nuts 30*b* are threaded onto securing elements 18.

Figure 4:
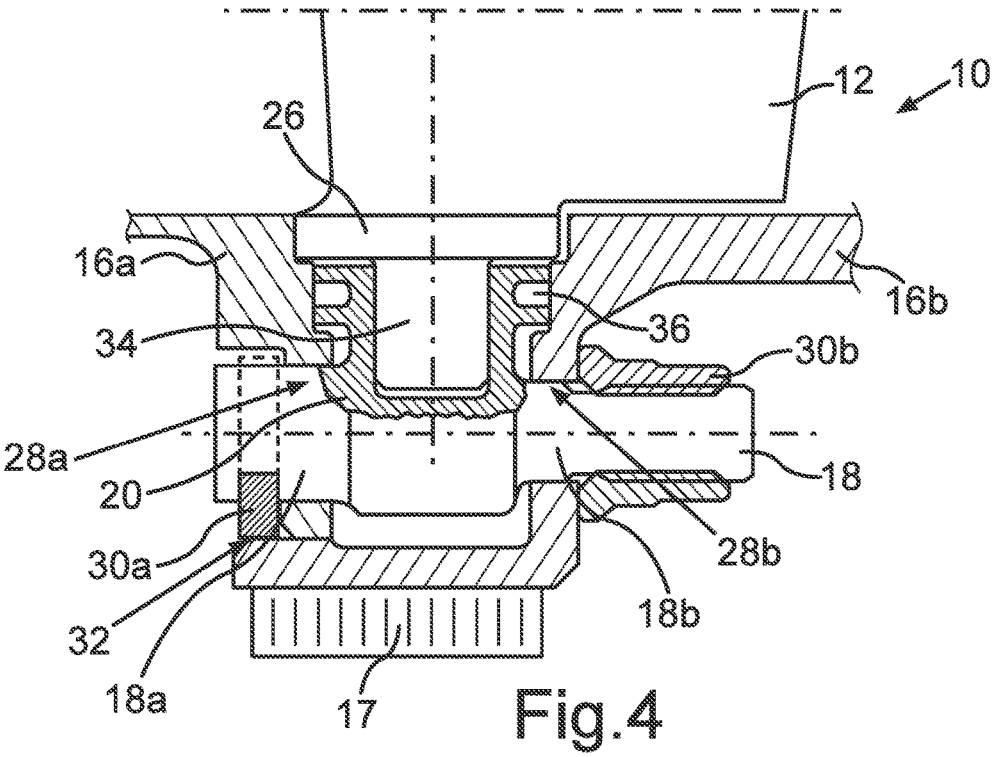
FIG. 4 is a schematic cross-sectional side view of an inventive inner ring for an annular guide vane assembly according to a second exemplary embodiment.

FIG. 4 shows, in schematic cross-sectional side view, an inventive inner ring 14 for an annular guide vane assembly 10 according to a second exemplary embodiment. The basic design and the assembly and disassembly of annular guide vane assembly 10 correspond essentially to the first exemplary embodiment. In contrast to the first exemplary embodiment, securing element 18 has here a vane bearing 20 in the form of a bushing or hole which is positioned a trunnion 34 of the associated guide vane 12. Furthermore, vane baring 20 of securing element 18 is sealed with respect to first securing ring 16*a* and second securing ring 16*b* by means of a sealing element 36 in the form of a sealing ring or piston ring. During assembly, sealing element 36 is placed on the exterior of vane bearing 20 prior to the positioning of securing rings 16*a*, 16*b*.

Figure 5:
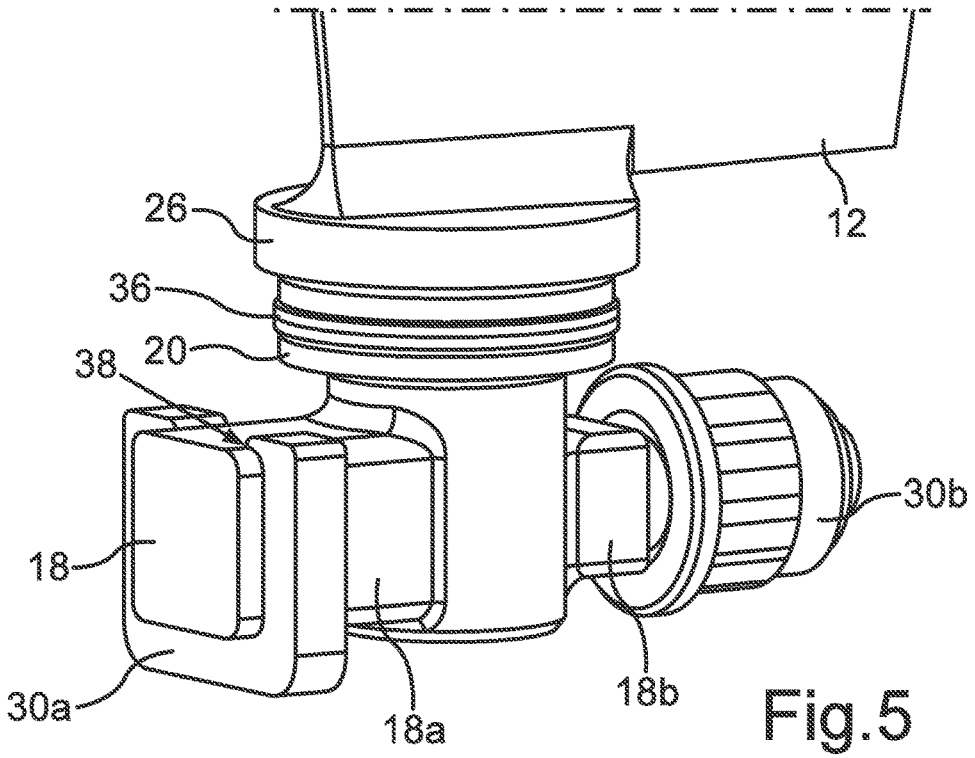
FIG. 5 is a schematic perspective view of a securing element shown in FIG. 4.

For further illustration, FIG. 5 shows a schematic perspective view of the securing element 18 depicted in FIG. 4, with guide vane 12 disposed in the vane bearing 20 thereof. It can be seen that check plate 30*a* has been pushed into a groove 38 in an end region of securing element 18. Also shown are the regions 18*a*, 18*b*, which are square in shape and serve to interlockingly and non-rotatably position securing element 18.

Figure 6:
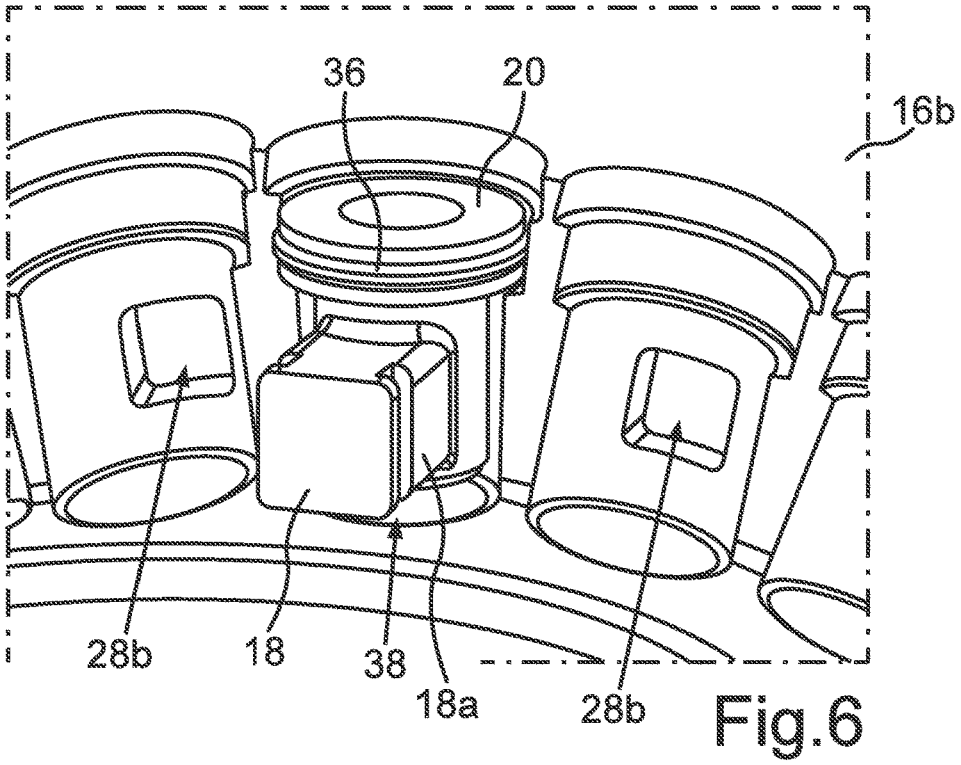
FIG. 6 is a schematic perspective view showing the securing element disposed in a securing ring.

FIG. 6 shows a schematic perspective view of securing element 18, which is disposed in mounting aperture 28*b* of the axially rearward securing ring 16*b*. In this view, there can be seen the square shape of mounting apertures 28*b*, which corresponds to the region 18*b* of the various securing elements. Also shown is groove 38 of the securing element.

LIST OF REFERENCE NUMERALS

10 annular guide vane assembly
12 guide vane
14 inner ring
16*a* first securing ring
16*b* second securing ring
17 sealing element
18 securing element

18*a* region
18*b* region
20 vane bearing
22 opening
24 bushing
26 inner disk
28*a* mounting apertures
28*b* mounting aperture
30*a* retaining element
30*b* retaining element
32 receiving profile
34 trunnion
36 sealing element
38 groove
M centerline

What is claimed is:

1. An inner ring for an annular guide vane assembly of a turbomachine, the inner ring enabling variable guide vanes to be rotatably supported, the inner ring comprising:

a first securing ring and a second securing ring connected together by at least one securing element extending axially with respect to a centerline of the inner ring, the at least one securing element including a vane bearing projecting radially with respect to the centerline and corresponding to an associated guide vane for rotatably supporting the associated guide vane.

2. The inner ring as recited in claim 1 wherein the securing element includes a vane bearing in the form of a bushing in which is positionable a trunnion of the associated guide vane, or wherein the securing element includes a vane bearing in the form of a securing element trunnion which is positionable in a vane bushing of the associated guide vane.

3. The inner ring as recited in claim 1 wherein the first securing ring or the second securing ring are segmented.

4. The inner ring as recited in claim 1 wherein the first securing ring or the second securing ring carries a sealing element.

5. The inner ring as recited in claim 4 wherein the sealing element is a honeycomb seal.

6. The inner ring as recited in claim 1 wherein the securing element is non-rotatably disposed in a corresponding mounting aperture of the first securing ring or the second securing ring.

7. The inner ring as recited in claim 1 wherein the securing element is interlockingly, disposed in a corresponding polygonal mounting aperture of the first securing ring or the second securing ring.

8. The inner ring as recited in claim 1 wherein the securing element is coupled, in a first end region, to a retaining element in the form of a check plate.

9. The inner ring as recited in claim 8 wherein the check plate is U-shaped or disposed in a groove of the securing element.

10. The inner ring as recited in claim 8 wherein the first securing ring or the second securing ring have a receiving profile, the check plate being captively received in the receiving profile or wherein the check plate rests on the second securing ring.

11. The inner ring as recited in claim 1 wherein the securing element is affixed, in a second end region, to the second securing ring by a retaining element.

12. The inner ring as recited in claim 11 wherein the retaining element is a nut.

13. The inner ring as recited in claim 1 wherein a vane baring of the securing element is sealed with respect to the first securing ring or the second securing ring by means of a sealing element.

14. The inner ring as recited in claim 13 wherein the sealing element is a sealing ring.

15. A method for manufacturing an annular guide vane assembly of a turbomachine, comprising the steps of:

a) providing an outer ring and a plurality of variable guide vanes;

b) inserting radially outer vane bearings of the guide vanes into the outer ring;

c) connecting radially inner vane bearings of the guide vanes each to a respective radially projecting vane bearing of an associated securing element;

d) positioning a first securing ring on respective first end regions of the securing elements;

e) positioning a retaining element on each of the first end regions of the securing elements, the retaining elements limiting axial movement of the first securing ring relative to the securing elements;

f) positioning a second securing ring on respective second end regions of the securing elements such that the securing elements extend axially between the first and second securing rings; and g) positioning a retaining element on each of the second end regions of the securing elements, the retaining elements limiting axial movement of the second securing ring relative to the securing elements.

16. The method as recited in claim 15 wherein in step c), bushings are inserted, as radially inner vane bearings, into inner disks of the guide vanes, and trunnions are inserted, as radially projecting vane bearings of the securing elements, into the bushings or wherein, in step c), other trunnions are inserted, as vane bearings of the guide vanes, into respective other bushings as radially projecting vane bearings of the securing elements.

17. The method as recited in claim 15 wherein in step e), a retaining element in the form of a check plate is inserted radially from the inside into each of the grooves in the first end regions of the securing elements and, after positioning the second securing ring in step f), the retaining element rests on the second securing ring.

18. The method as recited in one of claim 15 wherein in step g), nuts are threaded, as retaining elements, onto the second end regions of the securing elements until the first and second securing rings are fixedly attached to one another via the securing elements.

19. A turbomachine comprising at least one inner ring (as recited in claim 1.

20. An annular guide vane assembly manufactured according to the method in claim 15.

21. An aircraft engine comprising the turbomachine as recited in claim 19.

* * * * *